US007017838B2

(12) United States Patent
Schmon

(10) Patent No.: US 7,017,838 B2
(45) **Date of Patent: *Mar. 28, 2006**

(54) SPRAY GUN

(75) Inventor: Ewald Schmon, Grafenberg (DE)

(73) Assignee: Sata-Farbspritztechnik GmbH & Co. KG, Kornwestheim (DE)

( * ) Notice: Subject to any disclaimer, the term of this patent is extended or adjusted under 35 U.S.C. 154(b) by 174 days.

This patent is subject to a terminal disclaimer.

(21) Appl. No.: 10/312,278

(22) PCT Filed: Jun. 27, 2001

(86) PCT No.: PCT/EP01/07324

§ 371 (c)(1),
(2), (4) Date: Jun. 4, 2003

(87) PCT Pub. No.: WO02/02242

PCT Pub. Date: Jan. 10, 2002

(65) Prior Publication Data

US 2003/0189105 A1 Oct. 9, 2003

(30) Foreign Application Priority Data

Jun. 30, 2000 (DE) ..... 100 31 857

(51) Int. Cl.
*B05B 7/02* (2006.01)

(52) U.S. Cl. ..... 239/526; 239/71; 239/296; 239/415; 239/528; 239/290; 239/527; 239/DIG. 14; 73/714; 73/753; 73/756

(58) Field of Classification Search ..... 239/398, 239/71, 74, 290, 296, 413, 414, 415, 417.5, 239/526, 527, 528, DIG. 14; 73/714
See application file for complete search history.

(56) References Cited

U.S. PATENT DOCUMENTS

| | | | | |
|---|---|---|---|---|
| 3,482,781 | A | 12/1969 | Sharpe | |
| 4,585,168 | A * | 4/1986 | Even et al. | 239/74 |
| 5,191,797 | A * | 3/1993 | Smith | 73/714 |
| 6,585,173 | B1 * | 7/2003 | Schmon et al. | 239/526 |

FOREIGN PATENT DOCUMENTS

| | | |
|---|---|---|
| JP | 56054328 | 5/1981 |
| JP | 06074850 | 3/1994 |

* cited by examiner

*Primary Examiner*—Dinh Q. Nguyen
(74) *Attorney, Agent, or Firm*—Martin Fleit; Paul D. Bianco; Fleit Kain Gibbons Gutman Bongini & Bianco P.L.

(57) ABSTRACT

A spray gun having a gun body; a nozzle assembly arranged on the gun body; a compressed air supply channel located in the gun body, controlled by a valve assembly, a regulator for adjusting the supply of the spray material, an actuating element for actuating the valve assembly) and the regulator and a pressure measuring device. A pressure measuring device, resistant to dirt, that contains a pressure sensor integrated into the gun body and is connected to the compressed air supply channel via a capillary (43) located within the gun body.

9 Claims, 8 Drawing Sheets

SPRAY GUN

BACKGROUND OF THE INVENTION

1. Field of the Invention

The invention relates to a spray gun.

2. Prior Art

When working with a spray gun, it is extremely important to adjust the spraying pressure to produce optimum atomization for optimum work results at a good working speed and high application efficiency. A spraying pressure that is too low can lead, e.g., to color changes in the base coating, to an increase in the orange-peel structure in clear coatings and plain lacquer, and to a reduction of working speed and possibly the stream width. On the other hand, a spraying pressure that is too high can cause too great an atomization of the spray material and thus to greater losses and undesired stress on the work environment. Also, during the spraying process, the available pressure should be monitored to recognize possible pressure drops due to additional loads on the compressed-air network or pressure increases due to the activation of resources.

Frequently a pressure-regulating valve with a manometer is connected to the input of the spray gun in order to adjust and monitor the spraying pressure. The pressure, which can be adjusted by means of an adjustment knob on the pressure-regulating valve, can be read on the manometer. However, this pressure-regulating valve with manometer at the air inlet of the paint spray gun leads to a lengthening of the spray gun, which produces poorer handling. In addition, due to the rerouted inner channels, the manometer or the pressure-regulating valve produces a pressure drop. Also, the pressure-regulating valve, which is usually screwed on, must be disassembled for cleaning the spray gun in washing devices or cleaning tanks, because the display accuracy of the manometer can be negatively affected by solvent or coating or paint residue entering the instrument. Therefore, the pressure-regulating valve with the manometer must be removed for each cleaning process, which is associated with considerable work effort.

Paint spray guns are also already known, which have a connection on the bottom side of the handle for coupling to a conventional manometer. The manometers that are regularly used usually have a semicircular or spiral-shaped, curved steel tube spring as the pressure sensor, whose change in shape caused by the pressure is displayed by a pointer on a corresponding instrumental dial. The steel tube spring and the display device are mounted in a special housing. However, for this configuration, the handling of the spray gun is also negatively affected by the coupled manometer. In addition, the manometer must be removed for cleaning the paint spray gun, so that relatively expensive coupling or connecting systems are required for connecting the manometer to the spray gun.

It has also already been proposed to attach a conventional manometer to the side of the gun body. Such a spray gun also exhibits worse handling due to the manometer, which projects outward to one side. In addition, such a spray gun must be handled with extreme care so that the manometer attached to one side is not damaged when the spray gun is laid down.

SUMMARY OF THE INVENTION

The problem of the invention is to create an easy-to-handle spray gun with a pressure-measurement device that is insensitive to contaminants.

This problem is solved according to the invention by a spray gun having the following features. In a spray gun with a gun body having a nozzle assembly arranged on the gun body, a compressed air supply channel arranged in the gun body with a valve assembly for controlling the compressed air supply to the nozzle assembly, a regulator for setting the spraying material supply, a control element for controlling the valve assembly and the regulator, and a pressure measurement device for detecting and displaying the pressure in the compressed air supply channel, the improvement characterized in that the pressure measurement device includes a pressure sensor integrated in the gun body, and in that said sensor is connected to the compressed air supply channel by means of a capillary tube arranged inside the gun body.

For the spray gun according to the invention, a pressure sensor of an integrated pressure-measurement device is also integrated in the gun body. This allows a very compact construction with a protected arrangement of the pressure sensor in the interior of the paint spray gun. In addition, the pressure sensor is connected to a compressed-air supply channel by means of a capillary tube. This capillary tube can prevent solvent used for cleaning the spray gun and coating or paint residue from penetrating into the region of the pressure sensor, which could negatively affect or prevent a regular pressure measurement. The paint spray gun according to the invention can be cleaned without disassembly of the measurement device, and there is no risk to the usually sensitive pressure sensor.

Advantageous embodiments and preferred refinements of the invention include the spray gun described above characterized (1) in that the pressure measurement device includes a display device integrated with the gun body, (2) in that the display device is installed in a handle of the gun body, (3) in that the pressure measurement device includes a display device arranged on a rear end part of the gun body, (4) in that the capillary tube is arranged between the compressed air supply channel and a pressure detection chamber for the pressure sensor, (5) in that the capillary tube is arranged in a connection channel between the pressure detection chamber and a part of the compressed air supply channel upstream of the valve assembly, (6) in that the capillary tube is arranged in a connection channel between the pressure detection chamber and a part of the compressed air supply channel downstream of the valve assembly, (7) in that the pressure measurement device includes a circuit arrangement arranged in the gun body, and (8) in that a compartment for a battery is arranged in the gun body.

In an especially preferred embodiment, the display device and an optional circuit arrangement for signal conversion and evaluation is also integrated, e.g., in the handle of the spray gun. In this way, the entire measurement device is mounted within the gun body and is optimally protected there against damage.

However, the display device, which can be configured as an analog or digital display, can be arranged on a rear end portion of the gun body such that the display field can be read from behind. This produces the advantage that the pressure display is always in the field of view during spraying.

In one possible embodiment, the capillary tube can be arranged in a connection channel, which lies between a pressure detection compartment and the air supply channel in the region of the gun inlet upstream of a valve assembly. In this configuration, the gun inlet pressure can be detected. However, the capillary tube can also be arranged in a connection channel between the pressure detection compartment and a part downstream of the valve device. In this way, the air pressure, which is adjusted by means of a regulator at the valve assembly and which is used for spraying, can be detected and displayed.

BRIEF DESCRIPTION OF THE DRAWINGS

Further details and advantages of the invention result from the following description of advantageous embodiments with reference to the drawing. Shown are.

DETAILED DESCRIPTION OF PREFERRED EMBODIMENTS OF THE INVENTION

Figure 1:
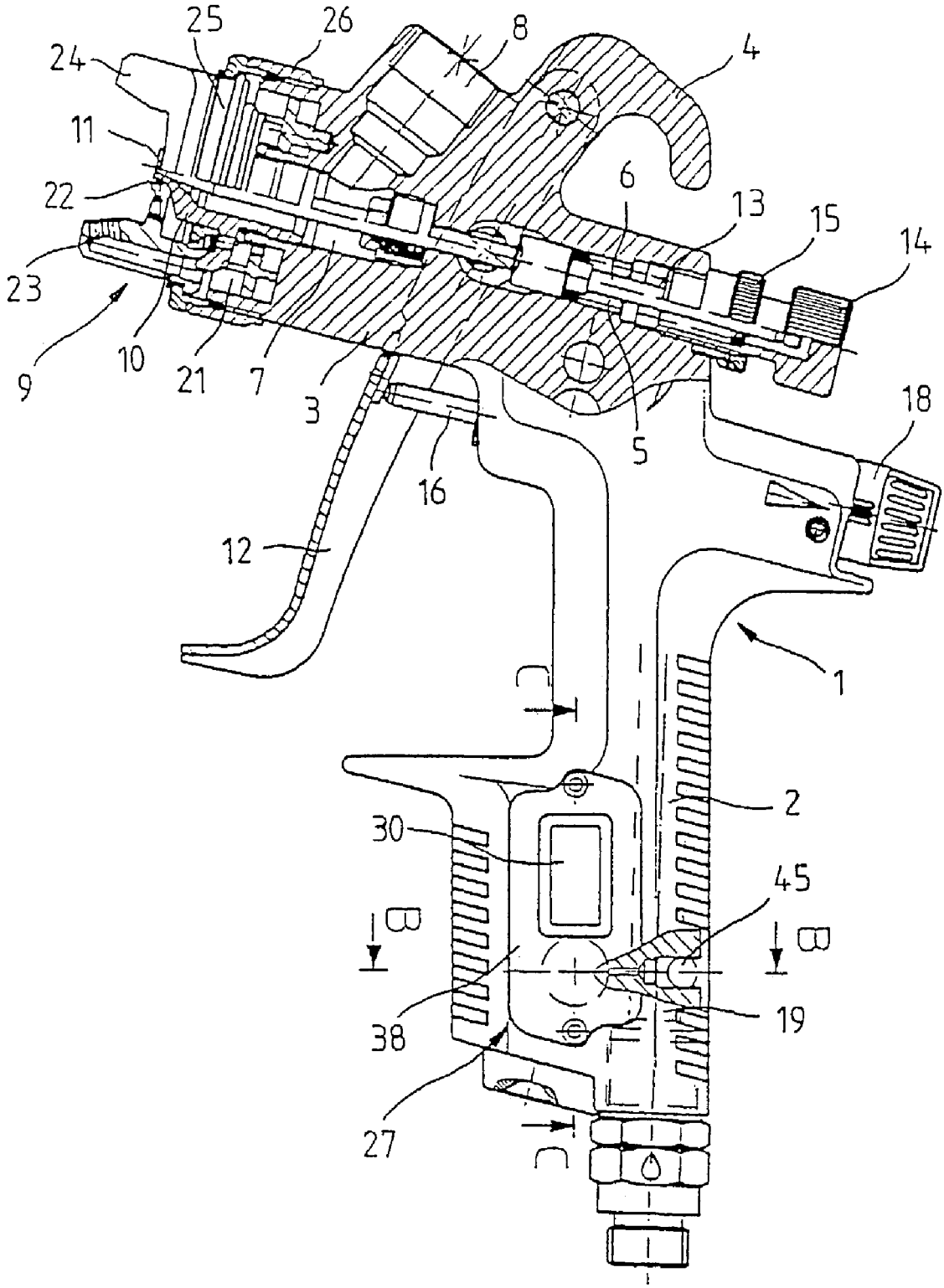
FIG. 1, a partially cutaway side view of a first embodiment of a spray gun.

The spray gun illustrated in FIG. 1 includes a gun body 1 with a handle 2 and a top part 3, on which a hanger hook 4 is formed. A through-hole 5, which extends from front to back, which has several stages, and in which a nozzle pin 6 can move in the axial direction, runs through the top part 3. The through-hole 5 forms an expanded receptacle 7 at the front, where there is an inclined supply hole 8 for mounting a paint storage container (not shown). A nozzle assembly 9 is attached to the front end of the through-hole 5. This nozzle assembly includes a paint nozzle 10 that can be fixed by means of threads on the top part 3 of the gun body 1. At its front end, the paint nozzle 10 has a nozzle hole 11, which provides a controllable supply of paint, coating, or the like, together with a front end part of the nozzle pin 6 that can move in the axial direction by means of a control lever 12 and that feeds the tip of the gun. The control lever 12 is connected to the nozzle pin 6 such that this pin is pushed backwards against the force of a spring 13 when the control lever 12 is pulled back and the nozzle hole 11 is opened in order to release paint. The pretensioning of the compression spring 13 and the stroke of the nozzle pin 6 can be adjusted by means of a setscrew 14 arranged on the rear end of the through-hole 5 with corresponding crown nut 15. By means of the control lever 12, a valve assembly 17, which can be seen in FIG. 4, can also be controlled by means of a rod 16 with a rear regulator 18 for controlling the compressed-air supply to the nozzle assembly 9.

Figure 4:
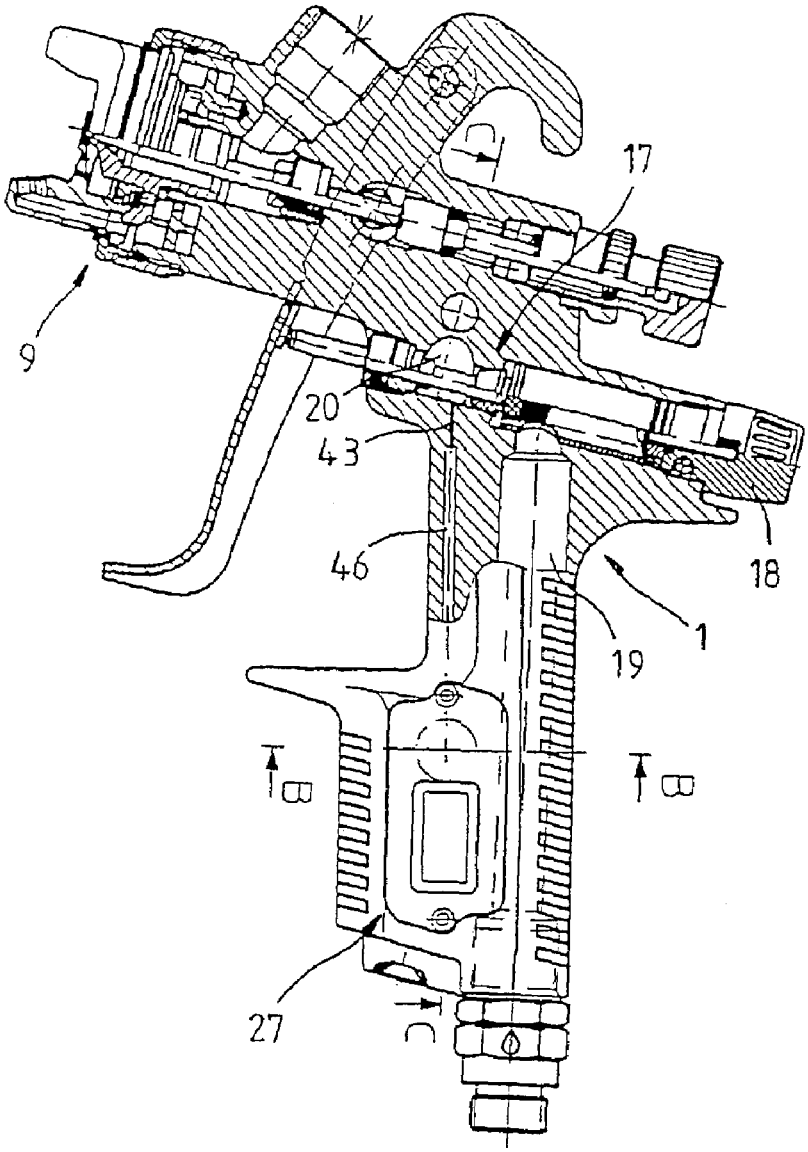
FIG. 4, a partially cutaway side view of a second embodiment of a spray gun.

A compressed-air supply channel in the gun housing 1 includes a part 19 upstream of the valve assembly 17 and a part 20, shown in FIG. 4, downstream of the valve assembly 17, which guide compressed air to an air conduction system 21 and from there to an annular gap 22, which surrounds the nozzle hole 11. The compressed air generates a vacuum in the region of the nozzle hole 11. This vacuum suctions the paint from the nozzle hole 11 and the paint is atomized with the compressed air under the formation of a circular stream. By means of so-called horn air holes 23 in the projecting horns 24 of an air cap 25 surrounding the paint nozzle 10, the compressed air for forming the circular stream can also be output in a flat stream. The air cap 25 can be fixed by means of coupling nut 26 to the top part 3 of the housing 1.

The nozzle assembly 9 and its construction is already known. A possible nozzle assembly is disclosed, e.g., in EP 07 10 506 A1. For further details relative to the nozzle assembly, refer to this publication, whose laid-open content is a topic of this application.

Figure 2:
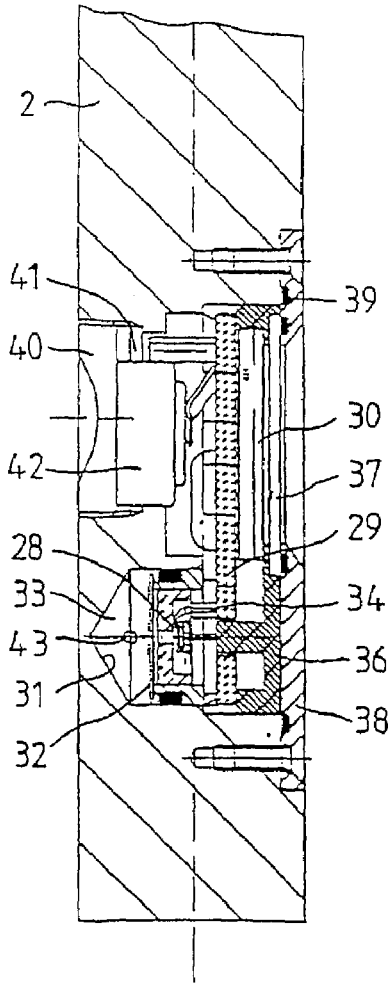
FIG. 2, an enlarged section view along line C—C of FIG. 1.

The spray gun includes a pressure-measurement device 27, which is integrated in the handle 2 of the gun body 1 and which essentially consists of a pressure sensor 28, a circuit arrangement 29, and a display device 30. As can be seen from FIG. 2, the pressure sensor 28 configured, e.g., as a piezoelectric pressure sensor, is inserted into a blind hole 31 in the side of the handle 2, which defines a pressure detection chamber 33 with a top measurement surface 32. The pressure sensor 28 is connected to the circuit arrangement 29 by means of electrical connections 34. This circuit arrangement essentially consists of a circuit board with the corresponding circuits arranged in a corresponding receptacle 35 in the gun handle 2. The display device 30 configured, e.g., as an LCD display, is arranged over the circuit arrangement 29 for the display of the pressure detected by the pressure sensor 28. The circuit arrangement 29 and the display device 30 are held over an intermediate element 36 by a cover plate 38 provided with a viewing window 37 in the gun handle 2. The cover plate 38 fitted to the side surface of the gun handle 2 is screwed on via sealing elements 39 sealing the gun handle 2 in order to prevent the entry of fluid and contaminants. On the side of the handle 2 opposite the display device 30 there is a compartment 41 for a battery 42 for electrical power supply of the evaluation circuit and the display device. This compartment can be closed with a cover 40.

Figure 3:
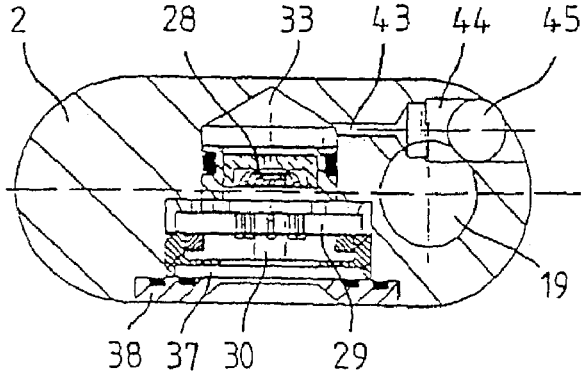
FIG. 3, an enlarged section view along line B—B of FIG. 1.

As can be seen especially from FIG. 3, the pressure detection chamber 33 is connected by a connection channel 44 with a capillary tube 43 to the part 19 of the compressed-air supply channel in the region of the gun inlet. This part is located upstream of the valve assembly. The capillary tube is configured as a hole with a diameter of 0.5–1.8 mm. For this configuration, the connection channel 44 is configured in the form of a lateral connection hole closed to the outside by means of a ball 45. The capillary tube 43 can prevent cleaning agents or solvents used during the cleaning of the spray gun and any loose coating particles from entering the pressure detection chamber, which could produce negative effects on the measurement accuracy or even prevent measurement.

Figure 6:
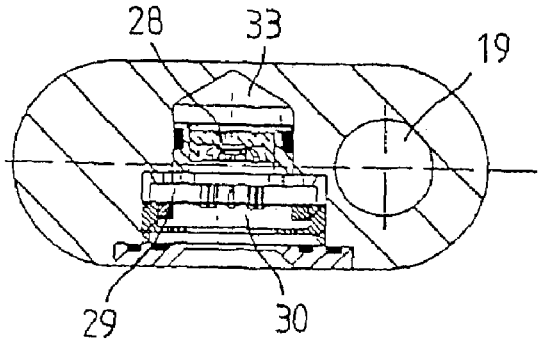
FIG. 6, an enlarged section view along line B—B of FIG. 4.
Figure 5:
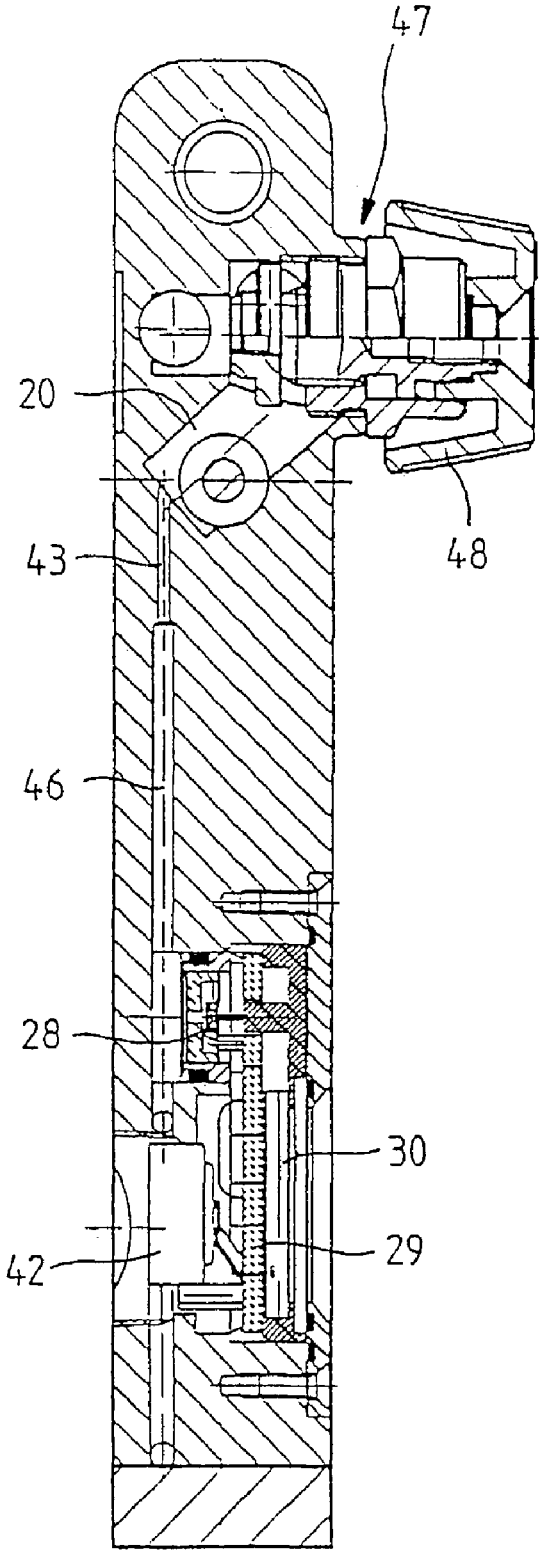
FIG. 5, an enlarged section view along line C—C of FIG. 4.

The configuration illustrated in FIGS. 4–6 is different from the previously described configuration in that the capillary tube 43 is arranged in a connection channel 46, which is between the pressure detection chamber 33 and a part 20 of the compressed air supply channel arranged downstream of the valve assembly 17. In this way, the air pressure set by the regulator 18 and available for spraying can be detected and displayed. In FIG. 5, another regulator 47 is shown with a lateral rotary knob 48 for regulating the compressed air supply to the holes 23. The other embodiment of the spray gun corresponds to that shown in FIGS. 1–3.

Figure 7:
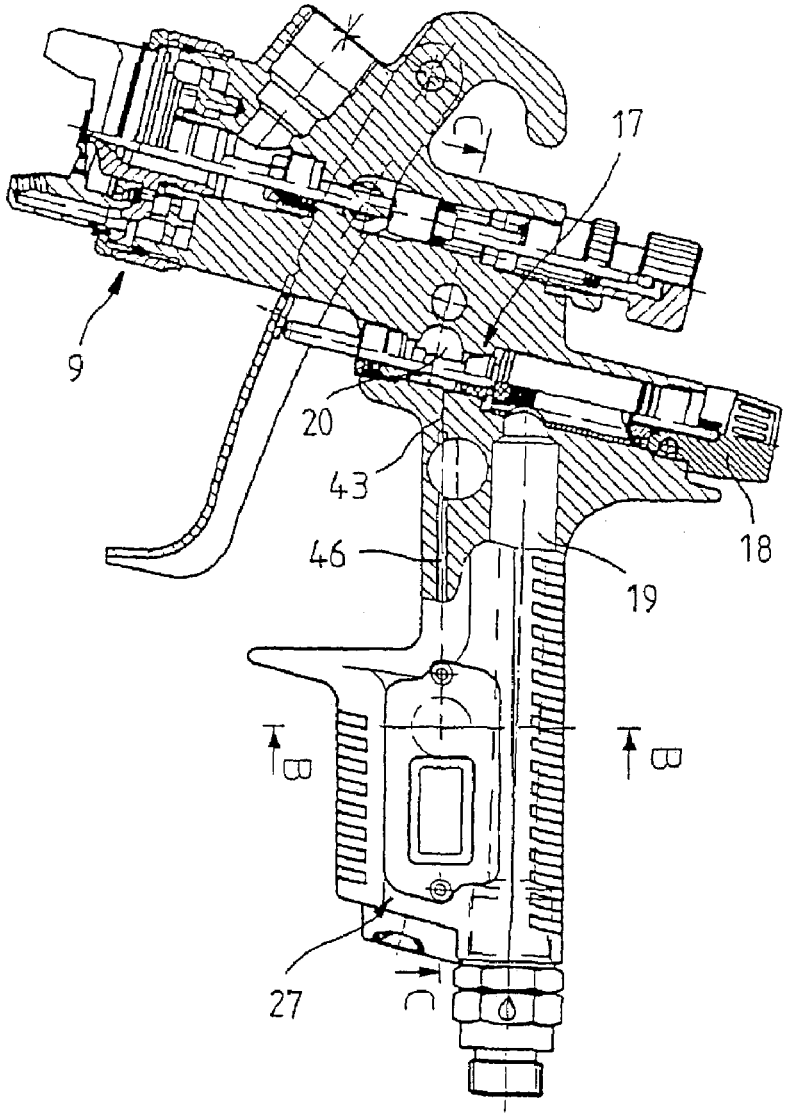
FIG. 7, a partially cutaway side view of a third embodiment of a spray gun.
Figure 9:
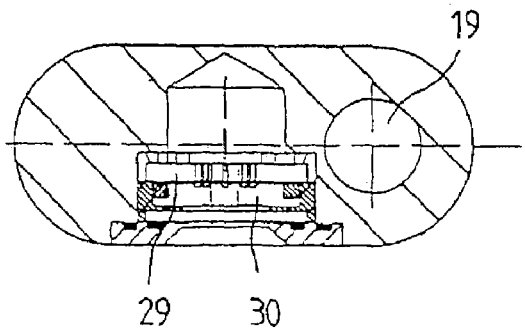
FIG. 9, an enlarged section view along line B—B of FIG. 7.
Figure 8:
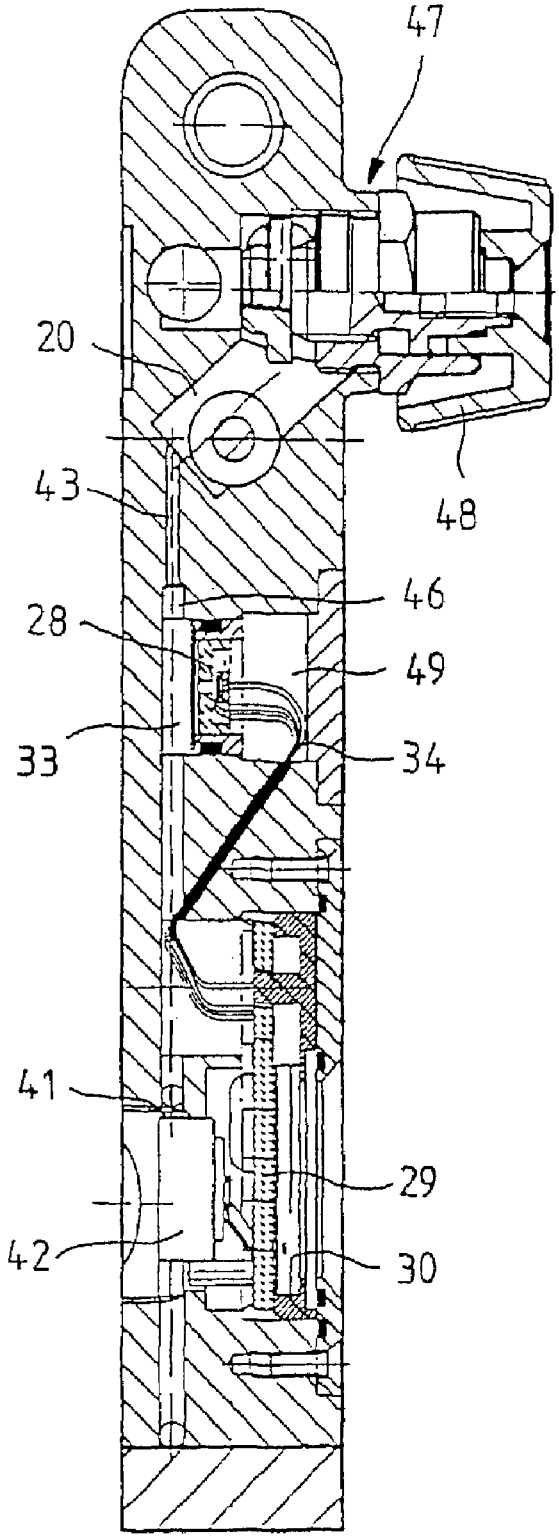
FIG. 8, an enlarged section view along line C—C of FIG. 7.

For the embodiment shown in FIGS. 7–9, the pressure sensor 28 is arranged in a separate receptacle 49 above the circuit arrangement 29, the display device 30, and the compartment 41 for the battery 42. Otherwise, the spray gun is essentially configured like the previously described embodiment according to FIGS. 4–6. Also for this embodiment, the operating pressure set by the regulator 18 can be sensed and displayed.

Figure 10:
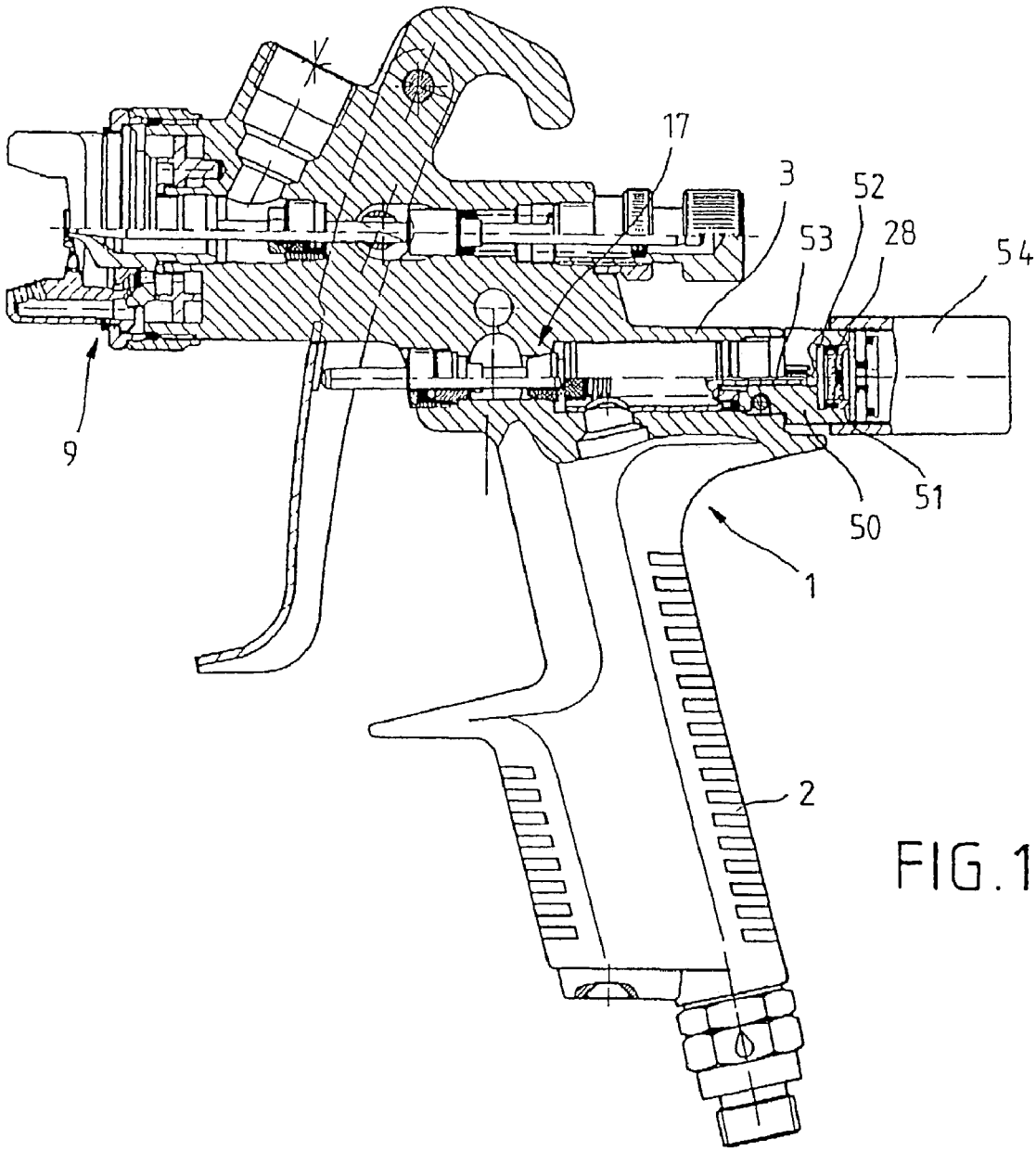
FIG. 10, a partially cutaway side view of a fourth embodiment of a spray gun.
Figure 11:
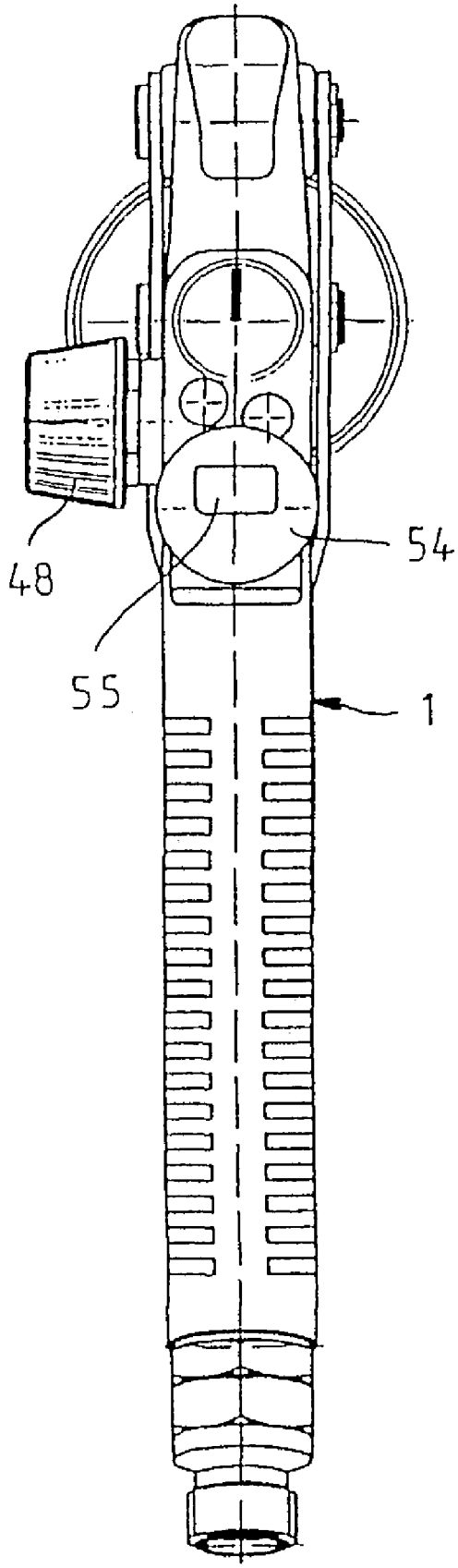
FIG. 11, a rear view of the spray gun of FIG. 10.

In FIGS. 10 and 11, another embodiment is shown. For this configuration, the gun body 1 has a rear end piece 50, which can be configured either integrally with the top part 3 or as an end part that can be, e.g., screwed on or inserted. The end piece 50 contains a receptacle 51 with a pressure detection chamber 52 for the pressure sensor 28. The pressure detection chamber 52 is connected by means of a capillary tube 53 arranged in the axial direction of the end part to the compressed air supply channel upstream of the valve assembly 17. On the end piece 50, there is a digital display device 54 with a display field 55 that can be seen from behind while working with the spray gun. The pressure can thus be monitored continuously during spraying.

The invention is not limited to the previously described embodiments illustrated in the drawing. For example, instead of piezoelectric pressure sensors, other suitable pressure probes or pressure sensors can also be used. In addition, the pressure sensor can also be attached to other suitable locations of the gun body.

The invention claimed is:

1. Spray gun with a gun body, a nozzle assembly arranged on the gun body, a compressed air supply channel arranged in the gun body with a valve assembly for controlling the compressed air supply to the nozzle assembly, a regulator for setting the spraying material supply, a control element for controlling the valve assembly and the regulator, and a pressure measurement device for detecting and displaying the pressure in the compressed air supply channel, characterized in that the pressure measurement device includes a pressure sensor integrated in the gun body, and in that said sensor is connected to the compressed air supply channel by means of a capillary tube arranged inside the gun body.

2. Spray gun according to claim 1, characterized in that the pressure measurement device includes a display device integrated with the gun body.

3. Spray gun according to claim 2, characterized in that the display device is installed in a handle of the gun body.

4. Spray gun according to claim 1, characterized in that the pressure measurement device includes a display device arranged on a rear end part of the gun body.

5. Spray gun according to claim 1, characterized in that the capillary tube is arranged between the compressed air supply channel and a pressure detection chamber for the pressure sensor.

6. Spray gun according to claim 5, characterized in that the capillary tube is arranged in a connection channel between the pressure detection chamber and a part of the compressed air supply channel upstream of the valve assembly.

7. Spray gun according to claim 5, characterized in that the capillary tube is arranged in a connection channel between the pressure detection chamber and a part of the compressed air supply channel downstream of the valve assembly.

8. Spray gun according to claim 1, characterized in that the pressure measurement device includes a circuit arrangement arranged in the gun body.

9. Spray gun according to claim 1, characterized in that a compartment for a battery is arranged in the gun body.

* * * * *